US011359385B2

(12) United States Patent
Yoo

(10) Patent No.: US 11,359,385 B2
(45) Date of Patent: Jun. 14, 2022

(54) BATHROOM FLOOR WATERPROOFING SYSTEM, METHOD OF MANUFACTURING THE SAME, AND METHOD OF CONSTRUCTING THE SAME

(71) Applicant: Yeong Geun Yoo, Andong-si (KR)

(72) Inventor: Yeong Geun Yoo, Andong-si (KR)

( * ) Notice: Subject to any disclaimer, the term of this patent is extended or adjusted under 35 U.S.C. 154(b) by 761 days.

(21) Appl. No.: 16/319,347

(22) PCT Filed: Jul. 20, 2017

(86) PCT No.: PCT/KR2017/007820
§ 371 (c)(1),
(2) Date: Jan. 20, 2019

(87) PCT Pub. No.: WO2018/016888
PCT Pub. Date: Jan. 25, 2018

(65) Prior Publication Data

US 2021/0301544 A1 Sep. 30, 2021

(30) Foreign Application Priority Data

Jul. 20, 2016 (KR) ..... 10-2016-0091734
Dec. 13, 2016 (KR) ..... 10-2016-0169510

(51) Int. Cl.
*E04F 15/02* (2006.01)
*E03D 11/16* (2006.01)
*E04B 1/66* (2006.01)

(52) U.S. Cl.
CPC ..... *E04F 15/02188* (2013.01); *E03D 11/16* (2013.01); *E04B 1/665* (2013.01)

(58) Field of Classification Search
CPC ..... E03D 11/16; E04B 1/665; E04F 2015/02; E04F 15/02038; E04F 15/18
See application file for complete search history.

(56) References Cited

U.S. PATENT DOCUMENTS 5,050,362 A * 9/1991 Tai ..... E04C 2/543 52/579
5,971,655 A * 10/1999 Shirakawa ..... E01C 5/20 404/34
9,200,445 B2 * 12/2015 Leines ..... E04F 15/04
(Continued)

FOREIGN PATENT DOCUMENTS

JP 2006-002368 A 1/2006
KR 20-0431681 Y1 11/2006
(Continued)

OTHER PUBLICATIONS

International Search Report for PCT/KR2017/007820 dated Nov. 22, 2017 from Korean Intellectual Property Office.

*Primary Examiner* — Paola Agudelo
(74) *Attorney, Agent, or Firm* — Revolution IP, PLLC

(57) ABSTRACT

A bathroom floor waterproofing system includes: a flat floor panel made of stainless steel; at least one drainage unit provided at the floor panel; side walls formed by bending a pair of opposite edges of the floor panel upwards; and a fastening unit comprising a male fastening plate formed by bending one of the edges of the floor panel upwards so as to be perpendicular to the floor panel and a female fastening plate into which the male fastening plate of an adjacent bathroom floor waterproofing system is detachably fitted and coupled.

5 Claims, 10 Drawing Sheets

(56) References Cited

U.S. PATENT DOCUMENTS

| | | | | |
|---|---|---|---|---|
| 10,334,993 | B1 * | 7/2019 | Nastasi | E04F 15/02188 |
| 2009/0064630 | A1 * | 3/2009 | Torres | A47K 3/40<br>52/741.1 |
| 2010/0257801 | A1 * | 10/2010 | Anderson | E04F 15/087<br>52/391 |
| 2011/0113713 | A1 * | 5/2011 | Lui | E04F 15/02<br>52/391 |
| 2014/0033424 | A1 * | 2/2014 | Cook | B29C 45/14065<br>29/428 |
| 2017/0241124 | A1 * | 8/2017 | Erlebach | E03F 5/0408 |
| 2017/0326615 | A1 * | 11/2017 | Roy | B21D 53/00 |
| 2020/0141128 | A1 * | 5/2020 | Wedi | E04F 15/087 |

FOREIGN PATENT DOCUMENTS

| | | | |
|---|---|---|---|
| KR | 10-2008-0086329 | A | 9/2008 |
| KR | 10-0934004 | B1 | 12/2009 |
| KR | 10-1126725 | B1 | 3/2012 |
| KR | 10-1564993 | B1 | 11/2015 |

* cited by examiner

--Prior Art--

BATHROOM FLOOR WATERPROOFING SYSTEM, METHOD OF MANUFACTURING THE SAME, AND METHOD OF CONSTRUCTING THE SAME

TECHNICAL FIELD

The present invention relates to a bathroom floor waterproofing system, a method of manufacturing the same, and a method of constructing the same, and more particularly to a bathroom floor waterproofing system that is made of stainless steel, wherein a floor panel is integrally formed with side walls, thereby improving the waterproofing effect and efficiency of construction of a bathroom floor, wherein a plurality of waterproofing systems is detachably coupled to each other such that when water leaks from a certain one of the waterproofing systems or a certain one of the waterproofing systems is damaged, it is possible to replace the defective waterproofing system, thereby reducing replacement cost and time and thus improving economic efficiency, a method of manufacturing the same, and a method of constructing the same.

BACKGROUND ART

In general, a bathroom is a place in which sanitary facilities, such as a toilet bowl, a washbowl, and a shower booth, are installed and which frequently contacts water. In particular, the floor in the bathroom is required to be thoroughly waterproofed, since the floor is frequently in contact with water.

Therefore, various methods for waterproofing bathroom floors have been proposed. Typically, a wet type construction method and a dry type construction method are used.

In the wet type construction method, a plurality of waterproof layers is formed on a concrete floor in a bathroom through liquid waterproofing work, and then tiles are arranged on the surface thereof. A series of working processes of making waterproofing liquid uniformly permeate the floor and stacking cement paste having a waterproofing agent mixed therewith and waterproof mortar thereon is repeated several times to form a waterproof layer structure.

In the wet type construction method, however, the process of applying and drying waterproof materials is repeatedly performed, whereby the construction time is increased. In addition, construction must be performed by skilled workers, since the difficulty of construction is high. As a result, personnel expenses are increased. Furthermore, construction is not possible at sub-zero temperatures in the winter season. Moreover, it is difficult to guarantee uniform quality. Also, water leakage may occur due to cracks formed in the waterproof layers over time after construction. When water leakage occurs, the entire floor must be torn off, and then reconstruction must be performed.

Meanwhile, a bathroom constructed using the dry type construction method is called a unit bathroom (UBR), which is a bathroom that is completed by producing in advance materials necessary to form a floor, walls, and a ceiling of the bathroom in a factory and simply assembling the materials at a construction site.

FIG. 1 is a view showing a bathroom waterproofing structure constructed using a conventional dry type construction method disclosed in Korean Registered Patent No. 10-0934004 (published on Dec. 28, 2009).

Referring to the conventional art, the bathroom waterproofing structure includes a waterproof panel 10 made of a thermoplastic resin material, the waterproof panel including a floor surface 14 corresponding to the floor layer of a unit bathroom and a waterproof membrane 15*b* formed along the outer perimeter of the floor surface 14, the waterproof membrane having a predetermined height. Through-holes 13*a* and 13*b* are formed in the floor surface 14 so as to correspond to the number and position of drainage pipes, and a cement mortar layer 17 is formed on the floor surface 14. The waterproof panel 10 is formed by cutting each corner of a thermoplastic resin material sheet 11 by the same length L3 in the width direction and the length direction, bending cut surfaces 16*a* upwards, and joining the bent surfaces. The cement mortar layer 17 is formed so as to be inclined downwards toward a drainage port in order to prevent water from gathering thereon.

Reference numerals indicating the elements used to describe the conventional art are distinguished from reference numerals indicating elements of the present invention in the following description of the invention.

The conventional dry type construction method has advantages in that the bathroom waterproofing structure is formed so as to be directly disposed on the floor layer in the bathroom, whereby convenience in construction is improved and uniform quality is guaranteed. Since there is a difference in thermal expansivity between the thermoplastic resin used to form the waterproof panel 10 and the cement mixture used to form the cement mortar layer, however, the extent to which the waterproof panel contracts and expands due to temperature changes is different from the extent to which the cement mortar layer contracts and expands due to temperature changes, whereby cracks may be formed in the waterproof panel. In addition, a single sheet is bent in order to form a panel that is disposed on a single bathroom floor. Even in the case in which a portion of the panel is damaged, therefore, the entire panel must be replaced.

DISCLOSURE

Technical Problem

The present invention has been made in view of the above problems, and it is an object of the present invention to provide a bathroom floor waterproofing system used to waterproof a bathroom floor, wherein the waterproofing system includes a floor panel and side walls, which are formed by bending a single stainless steel sheet, thereby improving convenience in construction and waterproofing efficiency, and wherein a plurality of waterproofing systems is disposed on a single bathroom floor so as to be detachably coupled to each other such that when water leaks from a certain one of the waterproofing systems or when a certain one of the waterproofing systems is damaged, it is possible to separate and replace the defective waterproofing system, thereby improving convenience in maintenance, a method of manufacturing the same, and a method of constructing the same.

Technical Solution

In accordance with an aspect of the present invention, the above and other objects can be accomplished by the provision of a bathroom floor waterproofing system including a flat floor panel made of stainless steel, at least one drainage unit provided at the floor panel, the drainage unit including a soil pipe connected to a toilet bowl installed in a bathroom for discharging filth, a drainage pipe for draining soil discharged from a bathroom floor, a washbowl drainage pipe connected to a washbowl for draining soil discharged from the washbowl, a residual water pipe for discharging moisture contained in mortar concrete during construction or moisture introduced into the bathroom during/after construction and moisture generated in the bathroom due to a temperature difference after construction, and at least one drainage hole to which the soil pipe, the drainage pipe, the washbowl drainage pipe, and the residual water pipe are coupled, side walls formed by bending a pair of opposite edges of the floor panel upwards, and a fastening unit including a male fastening plate formed by bending one of the edges of the floor panel upwards so as to be perpendicular to the floor panel and a female fastening plate into which the male fastening plate of an adjacent bathroom floor waterproofing system is detachably fitted and coupled.

The female fastening plate may include an inner plate formed by bending the other of the edges of the floor panel upwards perpendicularly, an upper plate formed by bending the upper part of the inner plate outwards so as to be parallel to the middle of the floor panel, an outer plate formed by bending the tip of the upper plate downwards perpendicularly toward the floor panel, and a fastening groove defined between the inner plate and the outer plate.

The bathroom floor waterproofing system may further include a cover fitted onto the side wall of a plurality of bathroom floor waterproofing systems disposed so as to neighbor each other, wherein the cover may include a pair of vertical plates spaced apart from each other, a horizontal plate for interconnecting upper ends of the vertical plates, and a fitting groove defined between the vertical plates.

In accordance with another aspect of the present invention, there is provided a method of manufacturing a bathroom floor waterproofing system, the method including a first process of preparing a flat stainless steel sheet, forming a bent portion along the perimeter portion of the stainless steel sheet, and incising a part of the bent portion from the edge of the stainless steel sheet toward the middle thereof, a second process of bending remaining sides of the perimeter portion of the stainless steel sheet, excluding one side thereof, upwards perpendicularly along the bent portion to form a floor panel, side walls, and a male fastening plate, a third process of bending the perimeter portion of the stainless steel sheet upwards perpendicularly along one side of the bent portion located opposite the male fastening plate, bending the upper end of the perimeter portion horizontally so as to face the outward direction of the stainless steel sheet, and bending the tip of the perimeter portion downwards to form a female fastening plate, a fourth process of integrally welding the side walls, the male fastening plate, and the female fastening plate to the floor panel by argon welding, a fifth process of forming at least one drainage hole in the floor panel, and a sixth process of inserting one of a soil pipe, a drainage pipe, a washbowl drainage pipe, and a residual water pipe through the drainage hole and fixing the inserted pipe by argon welding.

In accordance with a further aspect of the present invention, there is provided a method of constructing a bathroom floor waterproofing system, the method including a waterproofing system location process of fitting and coupling a soil pipe, a drainage pipe, a washbowl drainage pipe, and a residual water pipe provided at a waterproofing system into a plurality of drainage holes formed in advance in a concrete floor of a bathroom such that the bottom of the waterproofing system comes into tight contact with the top of the concrete floor, a mortar filling process of applying mortar onto the floor panel of the waterproofing system, and a tile finishing process of attaching tiles to the top of the mortar, wherein the tile finishing process is performed such that the surface height of the tiles is lower than the height of each side wall of the waterproofing system.

The method may further include a waterproofing system coupling process of locating a plurality of waterproofing systems so as to neighbor each other and coupling adjacent waterproofing systems to each other through a fastening unit after waterproofing system location process.

The method may further include a cover coupling process of coupling covers to corresponding side walls of adjacent waterproofing systems to fix the waterproofing systems after the waterproofing system coupling process.

Advantageous Effects

The waterproofing system according to the present invention is made of stainless steel. Stainless steel exhibits higher thermal expansivity than FRP or PP, whereby stainless steel hardly expands and contracts when temperature changes. Consequently, no cracks are formed in the waterproofing system even when the waterproofing system is used for a long period of time. In addition, since the waterproofing system exhibits excellent processability, the waterproofing system is easily bent and welded at a construction site. When the waterproofing system is stored, therefore, it is possible to reduce the volume of the waterproofing system. Furthermore, the possibility of damage to waterproofing systems when the waterproofing systems are transported in the state in which the waterproofing systems overlap each other is reduced.

Also, in the case in which the actual area of a bathroom floor is slightly different from the area of the bathroom floor at the stage of design due to errors of a worker during construction, the waterproofing system has high ability to cope with various situations that occur at a construction site, since the waterproofing system can be bent within an allowable bending range of the bent portion.

In addition, a plurality of waterproofing systems is capable of being connected for construction depending on the area of the bathroom floor. In the case in which water leaks from some of the waterproofing systems or it is necessary to repair some of the waterproofing systems after construction, therefore, it is possible to replace only the defective waterproofing systems, whereby construction time and cost may be reduced, compared to the conventional case, in which the entire floor must be replaced when leakage occurs.

Also, in the case in which a single waterproofing system is constructed, construction of the waterproofing system is not possible in the state in which the walls of the bathroom are completed. The present invention solves this problem. A plurality of waterproofing systems is arranged such that adjacent waterproofing systems are detachably coupled to each other, whereby the maintenance of the waterproofing systems is easily achieved without interrupting the waterproofing performance of the waterproofing systems.

Furthermore, the respective pipes of the waterproofing system are inserted through the drainage holes formed in advance, and the waterproofing system is located on the concrete floor, whereby it is possible to reduce construction time. In addition, a plurality of waterproofing systems is detachably coupled to each other so as to be placed on a single bathroom floor. Even after all of the walls of the bathroom are completed, therefore, it is possible to easily place the waterproofing systems on the bathroom floor. Moreover, dislocation of the waterproofing systems arranged on the bathroom floor is prevented, whereby the quality of the waterproofing systems is improved.

BEST MODE

Hereinafter, preferred embodiments of a bathroom floor waterproofing system according to the present invention, a method of manufacturing the same, and a method of constructing the same will be described with reference to the accompanying drawings.

The above and other objects and features of the present invention will be more clearly understood from the following detailed description of the embodiments taken in conjunction with the accompanying drawings.

Unless otherwise defined, all terms used herein, including technical and scientific terms, have the same meanings as those commonly understood by one of ordinary skill in the art. It will be further understood that terms, such as those defined in commonly used dictionaries, should be interpreted as having meanings consistent with their meanings in the context of the relevant art and the present disclosure, and are not to be interpreted in an idealized or overly formal sense unless expressly so defined herein.

Figure 1:
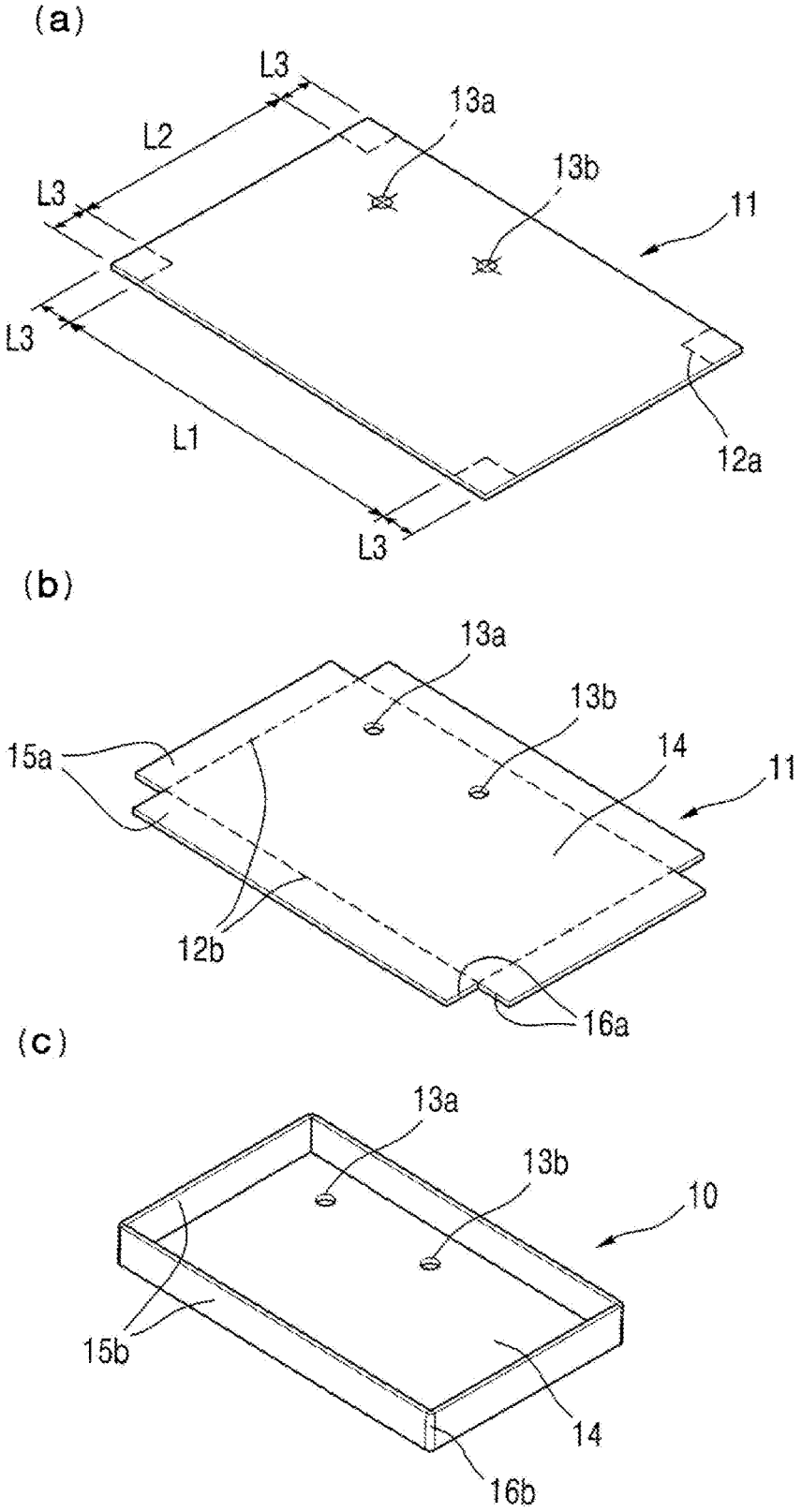
FIG. 1 is a schematic view showing a bathroom waterproofing structure constructed using a conventional dry type construction method.
Figure 2:
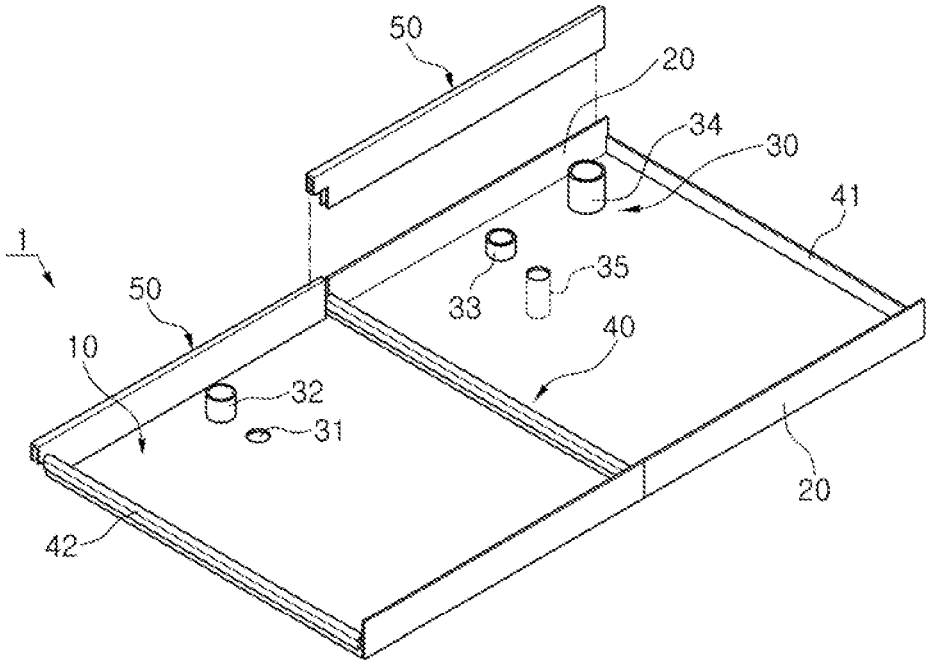
FIG. 2 is a view showing a bathroom floor waterproofing system according to the present invention in an assembled state.
Figure 3:
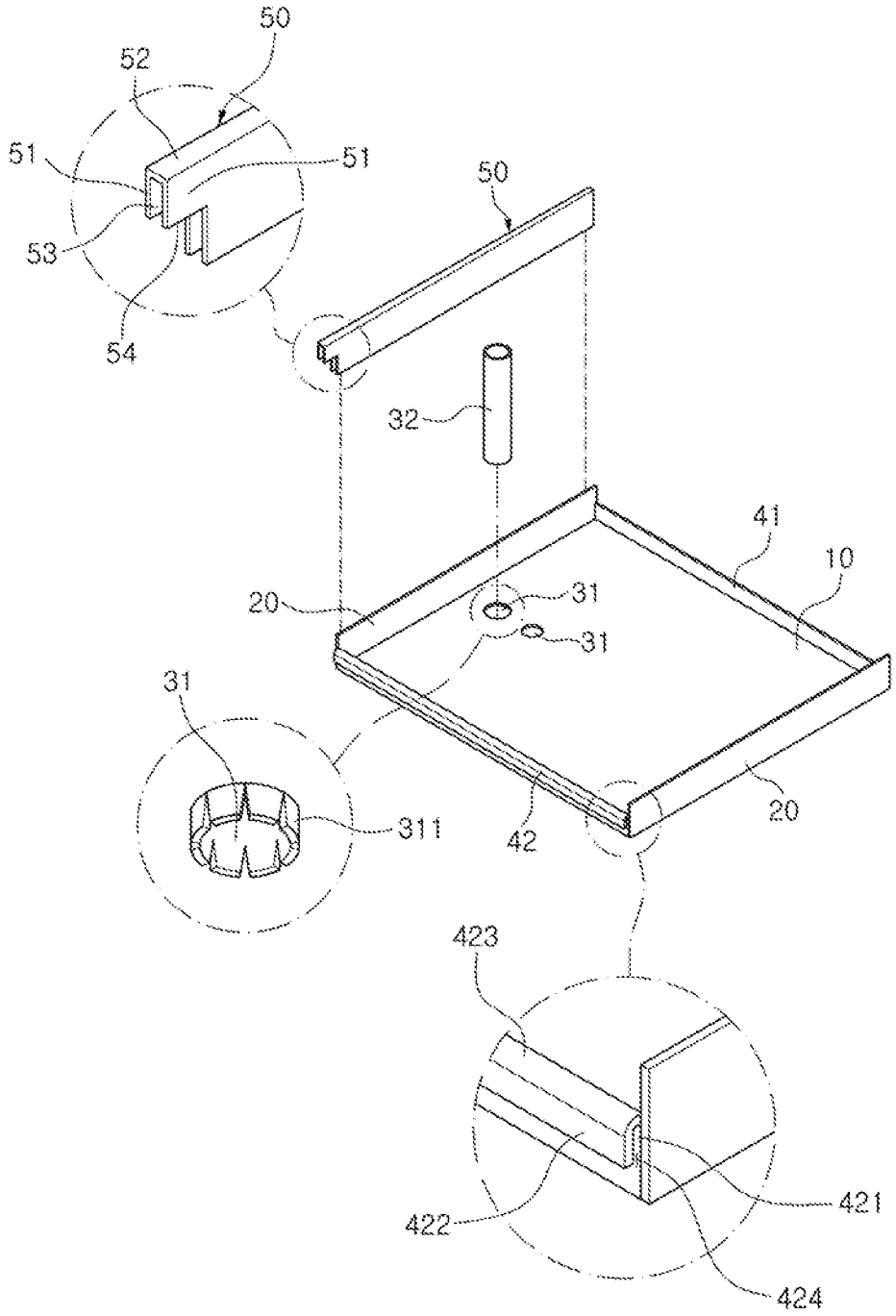
FIG. 3 is an exploded view showing the bathroom floor waterproofing system according to the present invention in a disassembled state.
Figure 4:
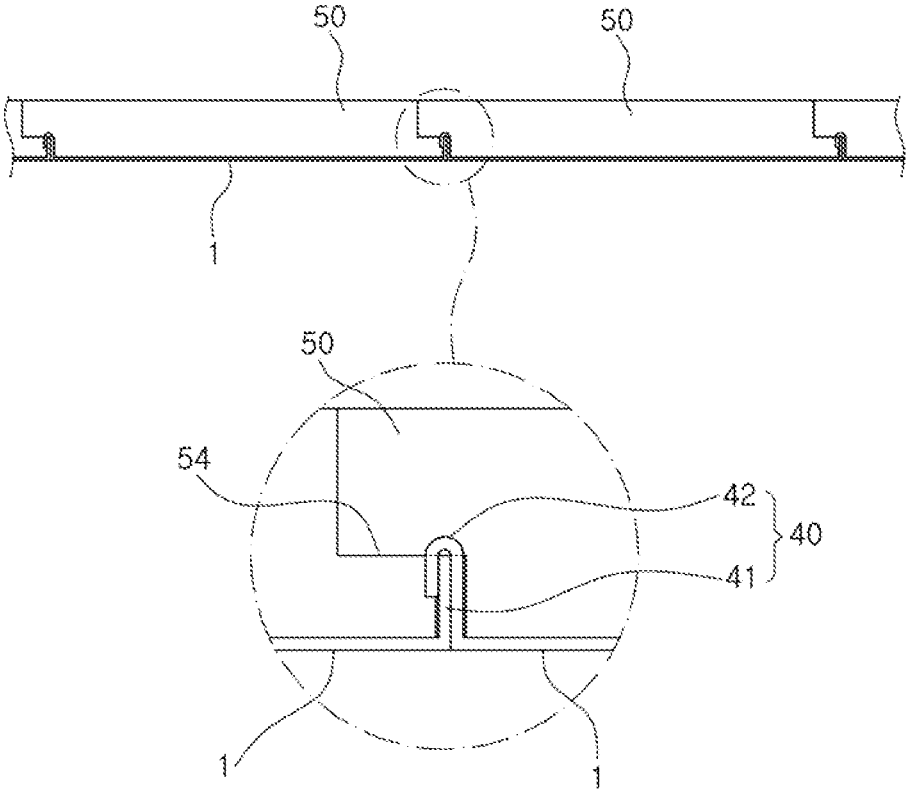
FIG. 4 is an enlarged view showing a fastening unit of the bathroom floor waterproofing system according to the present invention.

As shown in FIGS. 2 to 4, a bathroom floor waterproofing system 1 according to the present invention includes a floor panel 10, a drainage unit 30 formed in the floor panel 10, a plurality of side walls 20 bent upwards from the edge of the floor panel 10, a fastening unit 40 for coupling with another waterproofing system 1 adjacent thereto, and a cover 50 for fixing a plurality of coupled waterproofing systems 1.

First, the floor panel 10 is flat and is made of stainless steel. The reason that the floor panel is made of stainless steel is that stainless steel is slow to rust due to the characteristics thereof, whereby stainless steel is suitable for use in a bathroom, which frequently contacts water and has plenty of moisture therein, and that stainless steel exhibits excellent processability.

In addition, the reason that the floor panel 10 and the side walls 20 are made of stainless steel is that metal has almost the same thermal expansivity as concrete. In the case in which the floor panel 10 and the side walls 20 are made of stainless steel, which is a kind of metal, the volume of the floor panel, the side walls, and concrete casted on the floor panel simultaneously increases or decreases when temperature changes, whereby cracks are prevented from being formed in the casted concrete, and at the same time the floor panel and the side walls are prevented from being damaged.

In the case of a conventional waterproofing system made of fiber glass reinforced plastic (FRP) or polypropylene (PP), the waterproofing system expands and contracts when the temperature changes, and when the waterproofing system is used for a long period of time, the waterproofing system repeatedly expands and contracts, whereby the waterproofing system is deformed and cracks are formed in the waterproofing system. As a result, the waterproofing performance of the waterproofing system is reduced. In addition, since the waterproofing system made of FRP or PP exhibits lower processability than stainless steel, it is necessary to transport and construct the waterproofing system in the form of a finished product having a fixed size and shape. In this case, however, it is difficult to store the waterproofing system due to the volume thereof, and the waterproofing system may be damaged during transportation. Furthermore, the waterproofing system has poor ability to cope with various situations that occur at a construction site. That is, in the case in which the area of a bathroom floor on which the waterproofing system is to be constructed is slightly larger or smaller than the area of the bathroom floor at the stage of design, it is not possible to cut a portion of the waterproofing system made of FRP or PP and formed as a finished product. If a portion of the waterproofing system is cut, the waterproofing performance of the waterproofing system is reduced.

Also, if FRP or PP is bumped or dropped during construction, cracks may be formed in a portion of FRP or PP, or a portion of FRP or PP may be cut.

Therefore, the reason that the material for the waterproofing system is defined as stainless steel is that stainless steel exhibits higher thermal expansivity than FRP or PP, whereby stainless steel hardly expands and contracts when temperature changes. Consequently, no cracks are formed in the waterproofing system even when the waterproofing system is used for a long period of time. In addition, since stainless steel exhibits excellent processability, stainless steel is easily bent and welded at a construction site. When the waterproofing system is stored, therefore, it is possible to reduce the volume of the waterproofing system. Furthermore, the possibility of damage to waterproofing systems when the waterproofing systems are transported in the state in which the waterproofing systems overlap each other is reduced.

Also, in the case in which the actual area of a bathroom floor is slightly different from the area of the bathroom floor at the stage of design due to errors of a worker during construction, the waterproofing system has high ability to cope with this situation, since the waterproofing system exhibits high processability.

Next, at least one drainage unit 30 is formed in the floor panel 10. The drainage unit 30 includes at least one of a soil pipe 32 connected to a toilet bowl installed in the bathroom for discharging filth, a drainage pipe 33 for draining the soil discharged from the floor panel, or a washbowl drainage pipe 34 connected to a washbowl for draining soil discharged from the washbowl, a residual water pipe 35 for discharging moisture contained in mortar concrete during construction, moisture introduced into the bathroom during construction, or moisture generated in the bathroom due to a temperature difference after construction, and drainage holes 31 formed in the floor panel 10 such that the soil pipe 32, the drainage pipe 33, the washbowl drainage pipe 34, and the residual water pipe 35 are coupled to the drainage holes.

Each of the soil pipe 32, the drainage pipe 33, the washbowl drainage pipe 34, and the residual water pipe 35 is a hollow pipe. The soil pipe 32 and the washbowl drainage pipe 34 are connected respectively to the toilet bowl and to the washbowl, and extend vertically from the floor panel 10 such that the height of the upper ends thereof is higher than the height of tiles disposed on the floor panel 10.

Meanwhile, the drainage pipe 33 is configured to drain water from the bathroom floor, and extends vertically from the floor panel 10 such that the height of the upper end thereof is equal to the surface height of the tiles disposed on the floor panel 10.

Meanwhile, the residual water pipe 35 is configured to drain moisture contained in mortar concrete during construction, moisture introduced through gaps between the tiles after construction, or moisture generated due to a temperature difference after construction. The residual water pipe may extend downwards from the surface of the floor panel 10 such that the height of the upper end thereof is equal to the surface height of the floor panel 10.

In addition, when a plurality of waterproofing systems 1 is coupled to each other, at least one of the soil pipe 32, the drainage pipe 33, or the washbowl drainage pipe 34 may be included in each waterproofing system 1. The residual water pipe 35 is essentially included in each waterproofing system 1. The reason for this is that the position of the soil pipe 32, the drainage pipe 33, and the washbowl drainage pipe 34 may be changed depending on the design of the bathroom, whereby at least one thereof is disposed in each of the coupled waterproofing systems 1, and the residual water pipe 35 is essentially included in each waterproofing system 1 in order to discharge the water drained from the surface of the floor panel 10.

A plurality of drainage holes 31 may be formed vertically through one side of the floor panel 10 so as to be coupled to the soil pipe 32, the drainage pipe 33, the washbowl drainage pipe 34, and the residual water pipe 35.

In another embodiment of each drainage hole 31, the drainage hole 31 may be formed by incising a portion of the floor panel 10, and the incised portion may be bent upwards or downwards from the floor panel 10.

That is, as shown in the enlarged circle of FIG. 3, a plurality of incision lines is radially formed in the floor panel 10 from the center to the outer circumference of the drainage hole 31, the floor panel 10 is incised along the incision lines, and a plurality of incised pieces 311 formed in the floor panel is bent upwards or downwards. The diameter of the drainage hole 31 formed by bending the incised pieces 311 is equal to or larger than the outer diameter of each of the soil pipe 32, the drainage pipe 33, the washbowl drainage pipe 34, and the residual water pipe 35.

In the case in which the drainage hole 31 is coupled to each of the soil pipe 32, the drainage pipe 33, and the washbowl drainage pipe 34, the incised pieces 311 are bent upwards. When each of the soil pipe 32, the drainage pipe 33, and the washbowl drainage pipe 34 is inserted through the drainage hole 31, the incised pieces 311 are integrally fixed to a corresponding pipe by welding in the state of being in tight contact with the outer circumferential surface thereof such that a corresponding pipe is more securely coupled to the drainage hole.

The incised pieces 311 may be bent downwards from the floor panel 10. The reason for this is that if the incised pieces are bent upwards, moisture or foreign matter may be introduced through gaps between the incised pieces and the outer circumferential surface of each pipe. Therefore, the incised pieces may be bent downwards from the floor panel.

Meanwhile, since the height of the upper end of the residual water pipe 35 is equal to the surface height of the floor panel 10, the incised pieces 311 may be bent downwards from the floor panel 10 and may be integrally fixed to the residual water pipe by welding in the state of being in tight contact with the outer circumferential surface thereof such that the residual water pipe is securely coupled to the drainage hole 31.

Figure 8:
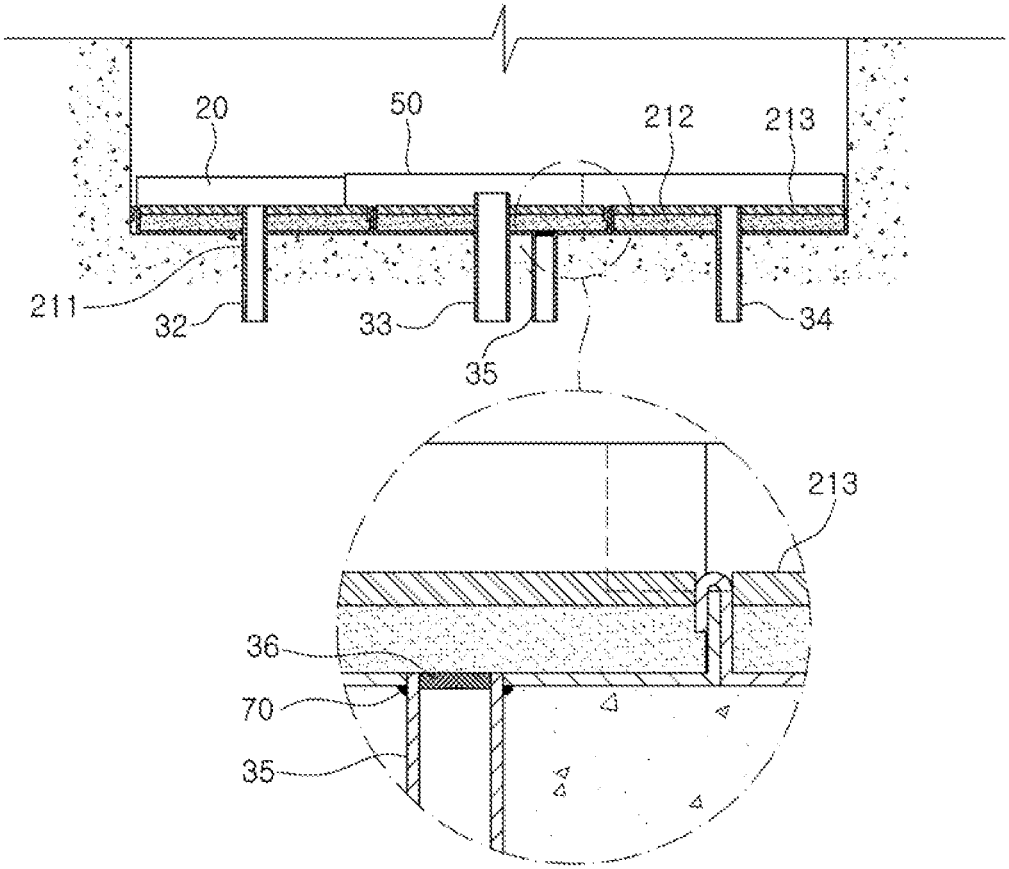
FIG. 8 is a conceptual view showing the state in which the bathroom floor waterproofing system according to the present invention is constructed using the method of constructing the bathroom floor waterproofing system according to the present invention.

In addition, the residual water pipe 35 is provided with a foreign matter filtering net 36 for filtering foreign matter from residual water to prevent the foreign matter from being introduced into the residual water pipe 35 and thus blocking the residual water pipe while the residual water is drained (see FIG. 8).

The foreign matter filtering net 36 may be provided in the drainage pipe 33, in addition to the residual water pipe 35.

Next, the side walls 20 extend upwards from the edge of the floor panel 10. Each side wall may be bent upwards perpendicularly from the edge of the floor panel 10, and may extend such that the upper end thereof is higher than the upper ends of the soil pipe 32 and the washbowl drainage pipe 34 of the drainage unit 30. Specifically, the upper end of each side wall 20 may be higher than the surface height of the mortar concrete and the tiles disposed on the floor panel 10. The reason for this is that it is necessary to prevent soil/waste water on the bathroom floor from flowing over the side walls 20.

Next, the fastening unit 40 is configured to detachably couple adjacent waterproofing systems 1 to each other when a plurality of waterproofing systems 1 is disposed. As shown in FIGS. 2 to 4, the fastening unit 40 includes a male fastening plate 41 and a female fastening plate 42.

The male fastening plate 41 may be bent upwards from the edge of the floor panel 10 so as to be perpendicular to the floor panel 10.

The female fastening plate 42 is formed at the floor panel 10 so as to face the male fastening plate 41, and includes an inner plate 421 formed by bending the edge of the floor panel 10 upwards perpendicularly, an upper plate 423 formed by bending the upper part of the inner plate 421 outwards so as to be parallel to the middle of the floor panel 10, an outer plate 422 formed by bending the tip of the upper plate 423 downwards perpendicularly toward the floor panel 10, and a fastening groove 424 defined between the outer plate 422 and the inner plate 421.

The fastening unit 40 is configured such that the male fastening plate 41 is inserted and coupled into the fastening groove 424 in the female fastening plate 42. When a plurality of waterproofing systems 1 is constructed, adjacent waterproofing systems 1 are detachably coupled to each other via the fastening unit.

A plurality of waterproofing systems 1 is connected to each other via the fastening unit 40 depending on the area of the bathroom floor. In the case in which water leaks from some of the waterproofing systems or it is necessary to repair some of the waterproofing systems after construction, therefore, it is possible to replace only the defective waterproofing systems 1, whereby construction time and cost may be reduced compared to the conventional case, in which the entire floor must be replaced when leakage occurs.

Also, in the case in which a single waterproofing system 1 is constructed, construction of the waterproofing system is not possible in the state in which the walls of the bathroom are completed. That is, since the planar area of the waterproofing system 1 is the same as the planar area of the bathroom floor, it is difficult to move the waterproofing system into the bathroom in the state in which the walls of the bathroom are completed.

The present invention solves this problem. A plurality of waterproofing systems 1 is arranged such that adjacent waterproofing systems 1 are detachably coupled to each other, whereby maintenance of the waterproofing systems is easily achieved without interrupting the waterproofing performance of the waterproofing systems.

Meanwhile, the height of the upper ends of the male fastening plate 41 and the female fastening plate 42 of the fastening unit 40 may be lower than the height of the upper ends of the side walls 20. Specifically, the upper end of the female fastening plate 42 may have the same height as the surfaces of the tiles disposed on the floor panel 10, whereby the female fastening plate may serve as a horizontal reference line for adjusting the height of the surfaces of the tiles when the tiles are assembled.

In addition, the waterproofing system 1 according to the present invention is configured such that when a constructed waterproofing system 1 is replaced, the interval at which the tiles disposed on the replaced waterproofing system 1 are arranged is the same as the interval at which the tiles were arranged on the bathroom floor in an initially constructed state. As described above, the tiles are constructed using the female fastening plate 42 of the waterproofing system 1 as the horizontal reference line for adjusting the height of the surfaces of the tiles, and at the same time, the upper end of the female fastening plate 42 is used as a width-direction or length-direction reference line while the tiles are assembled.

Consequently, a plurality of tiles is assembled into a single waterproofing system 1. At this time, as shown in FIG. 2 or 8, the edges of the tiles disposed at the border of the waterproofing system are adjusted in the width direction or in the length direction based on the upper end of the female fastening plate 42, whereby the tiles disposed on the waterproofing system 1 are arranged at uniform intervals, and at the same time, the tiles used in the waterproofing system 1 are disposed in spaces defined as the male fastening plate 41, the female fastening plate 42, and the opposite side walls 20 in order to reduce the number of tiles that are used when the waterproofing system 1 is replaced.

Although not shown in the drawings, in another embodiment of the waterproofing system according to the present invention, mortar concrete and tiles may be constructed on the waterproofing system 1 in advance, and then the waterproofing system 1 may be constructed on the bathroom floor, or may replace a defective waterproofing system 1 one to one.

Next, the cover 50 is configured to fix adjacent waterproofing systems 1 coupled to each other via the fastening unit 40, and includes a pair of vertical plates 51, a horizontal plate 52 for interconnecting the upper ends of the vertical plates 51, and a fitting groove 53 defined between the vertical plates 51.

Meanwhile, the cover 50 may be formed such that the width of the horizontal plate 52 gradually decreases from one side to the other side thereof, whereby the narrower side of the cover is inserted into the wider side of the cover. When a plurality of covers 50 is continuously coupled to the side walls 20, therefore, the narrower side of one cover is inserted into the fitting groove 53 in the wider portion of an adjacent cover, whereby the covers 50 are positioned and fixed without using additional fixing means (for example, bolts or nails).

The covers 50, configured as described above, are disposed so as to neighbor each other such that the side walls are fitted and coupled into the fitting grooves 53 in the state in which the side walls 20 are disposed on the same line.

Meanwhile, a location part 54, which is cut in an approximate "¬" form, is formed at the lower part of one side of the cover 50. The location part 54 is configured such that when the cover 50 is coupled to a corresponding side wall 20, the location part 54 prevents coupling therebetween from being impeded by the upper end of the male fastening plate 41. The location part 53 is disposed so as to contact the upper end of the male fastening plate 41.

Figure 9A:
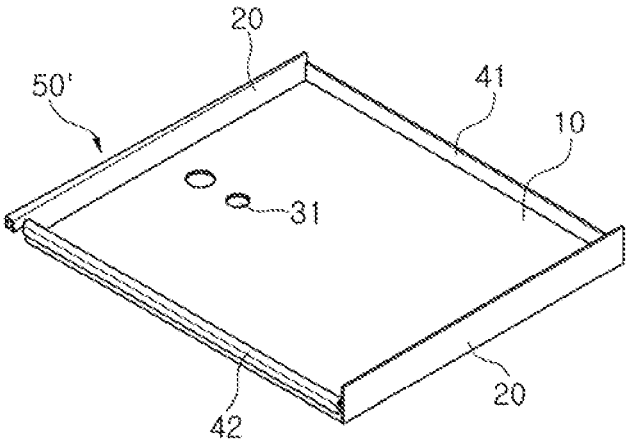
FIGS. 9*a* and 9*b* are schematic views showing other embodiments of a cover of the bathroom floor waterproofing system according to the present invention.
Figure 9B:
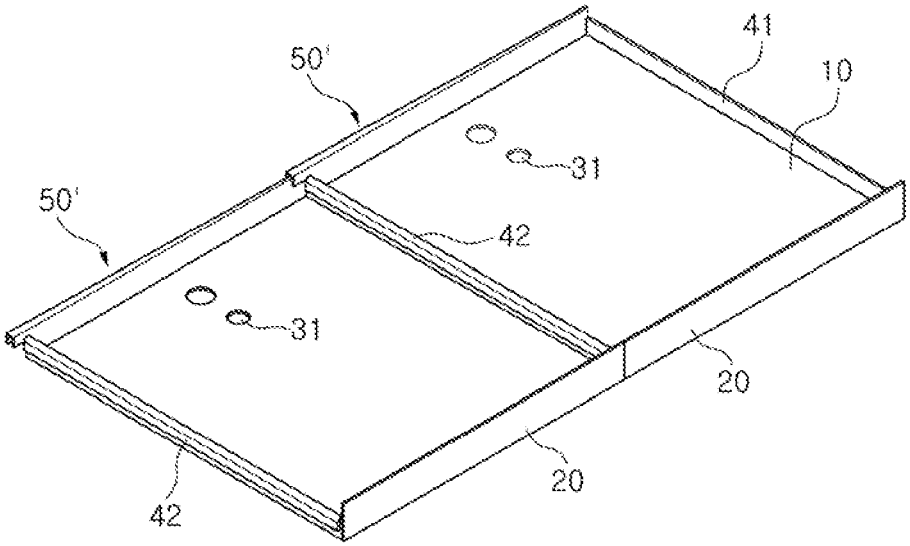

Meanwhile, in another embodiment 50' of the cover according to the present invention, as shown in FIGS. 9*a* and 9*b*, the cover may be formed by bending one of the side walls 20.

That is, the upper end of one of the side walls 20 is bent horizontally so as to face the outward direction of the floor panel, and then the tip thereof is bent downwards toward the floor panel. At this time, the width of the horizontally bent portion gradually increases from one side to the other side thereof, and the side of the horizontally bent portion disposed at the middle of the floor panel is formed by cutting the lower end thereof in an approximate "¬" form.

Consequently, the cover 50' may be integrally formed with the floor panel 10, and the side walls of adjacent floor panels may be fixed to each other through the covers 50' without using additional coupling means, whereby it is possible to reduce construction time.

Figure 10A:
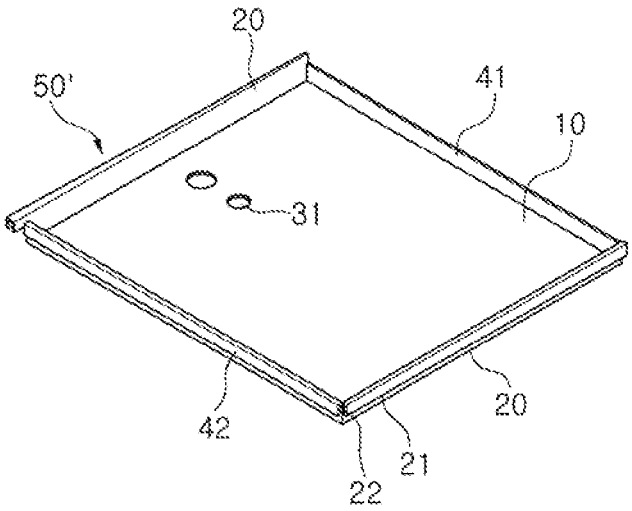
FIGS. 10*a* and 10*b* are schematic views showing other embodiments of the bathroom floor waterproofing system according to the present invention.
Figure 10B:
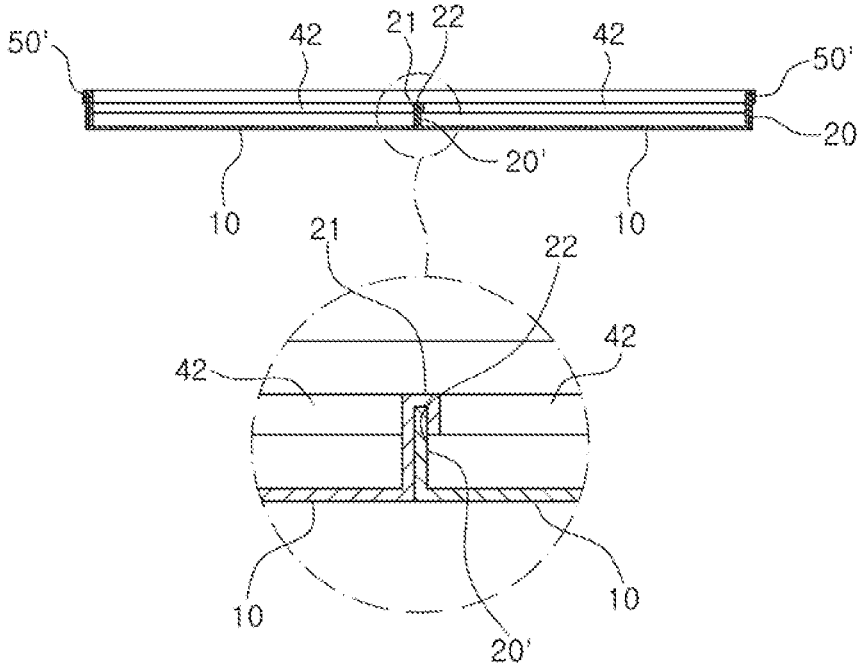

Meanwhile, in a further embodiment of the floor waterproofing system according to the present invention, as shown in FIG. 10, the floor waterproofing system 1 may be configured such that floor waterproofing systems can be continuously coupled to each other in all directions. To this end, one of the side walls 20 is bent to form a coupling part 21.

The side wall 20 may be bent outwards so as to have a sectional shape of '∩' such that the coupling part 21 is provided with a coupling groove 22, into which a side wall 20' of an adjacent floor waterproofing system 1 is inserted.

Although the coupling part 21 is shown as being formed at only one of the side walls 20, coupling parts 21 may be formed at a pair of side walls. In this case, a floor waterproofing system having coupling parts 21 formed at a pair of side walls 20 is disposed in the middle, and side walls 20' of adjacent floor waterproofing systems 1 are coupled and fixed into the coupling parts 21.

When a construction site has a wider area than the size of a floor waterproofing system 1, therefore, a plurality of floor waterproofing systems 1 may be connected to each other in all directions through the coupling parts 21. In addition, only a defective floor waterproofing system(s) 1 may be replaced during the use of the floor waterproofing systems 1, whereby convenience in maintenance is improved.

Figure 5:
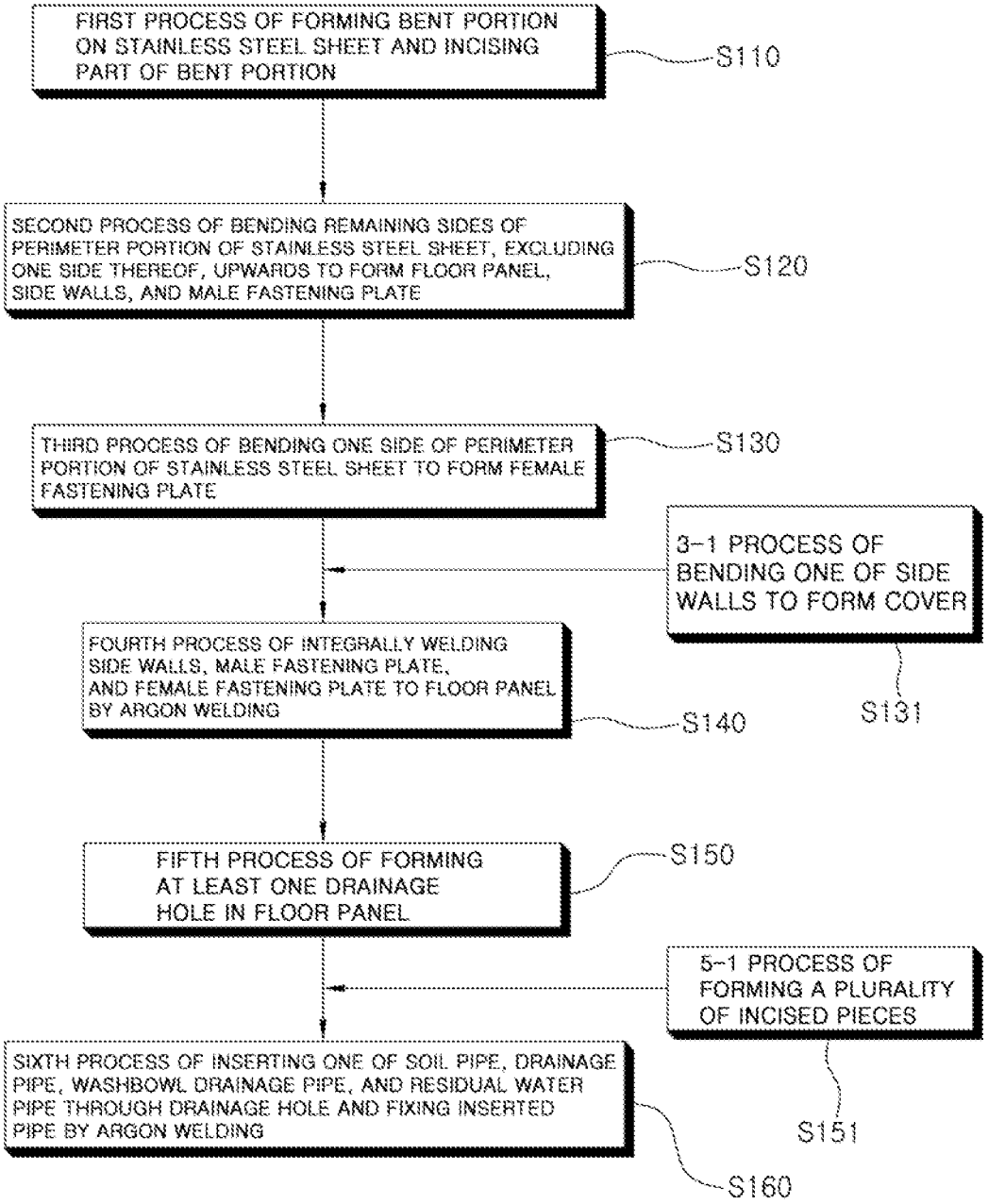
FIG. 5 is a flowchart showing processes of a method of manufacturing the bathroom floor waterproofing system according to the present invention.
Figure 6:
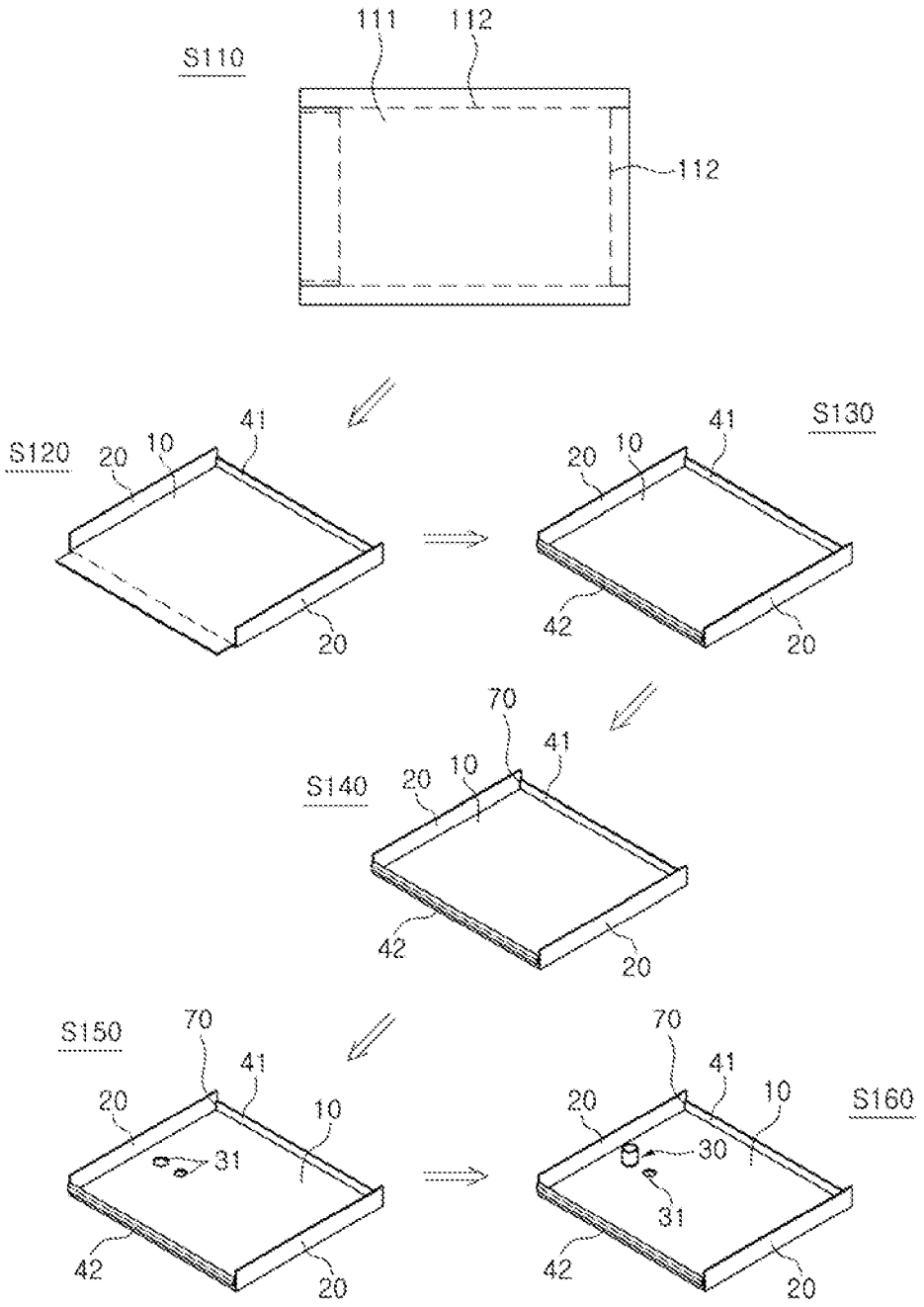
FIG. 6 is a conceptual view showing the processes of a method of manufacturing the bathroom floor waterproofing system according to the present invention.

FIGS. 5 and 6 show a method of manufacturing the bathroom floor waterproofing system according to the present invention. As shown, the method includes a first process of preparing a flat stainless steel sheet 111, forming a bent portion 112 along the perimeter portion of the stainless steel sheet 111, and incising a part of the bent portion 112 from the edge of the stainless steel sheet 111 toward the middle thereof (S110), a second process of bending the perimeter portion of the stainless steel sheet 111 upwards perpendicularly along the bent portion 112 to form a floor panel 10, side walls 20, and a male fastening plate 41 (S120), a third process of bending the perimeter portion of the stainless steel sheet 111 upwards perpendicularly along the bent portion 112 located opposite the male fastening plate 41, bending the upper end of the perimeter portion horizontally so as to face the outward direction of the stainless steel sheet 111, and bending the tip of the perimeter portion downwards to form a female fastening plate (S130), a fourth process of integrally welding the side walls 20, the male fastening plate 41, and the female fastening plate 42 to the floor panel 10 by argon welding (S140), a fifth process of forming at least one drainage hole 31 in the floor panel 10 (S150), and a sixth process of inserting at least one of a soil pipe 32, a drainage pipe 33, a washbowl drainage pipe 34, or a residual water pipe 35 through the drainage hole 31 and fixing the at least one inserted pipe by argon welding (S160).

The first process (S110) is a process of preparing a flat stainless steel sheet 111, forming a bent portion 112 along the perimeter portion of the stainless steel sheet 111, and incising a part of the bent portion 112 from the edge of the stainless steel sheet 111 toward the middle thereof.

At this time, the stainless steel sheet 111 is incised such that the incision length of one side thereof is greater than the incision length of the other side thereof. The reason for this is that the lengths of the male fastening plate 41 and the female fastening plate 42 are determined depending on the length by which the stainless steel sheet is incised in the first process and that the length of the female fastening plate 42 should be greater than the length of the male fastening plate 41.

The second process (S120) is a process of bending the perimeter portion of the stainless steel sheet 111 upwards perpendicularly along the bent portion 112 to form a floor panel 10, side walls 20, and a male fastening plate 41.

The bending portion 112 of the stainless steel sheet 111, having incised regions formed at opposite ends thereof in the first process (S110), is bent using a press bending machine such that a pair of side walls 20 is located so as to be opposite each other, and one side of the perimeter portion of the stainless steel sheet 111 is bent upwards perpendicularly to form a male fastening plate 41.

At this time, the height of the upper end of the male fastening plate 41 may be lower than the height of the upper end of each side wall 20.

The third process (S130) is a process of forming a female fastening plate 42 so as to be opposite the male fastening plate 41. The perimeter portion of the stainless steel sheet 111 is bent upwards along the bent portion 112 located opposite the male fastening plate 41 so as to be perpendicular to the floor panel 10 in order to form an inner plate 421, the upper end of the inner plate 421 is bent horizontally toward the outside of the stainless steel sheet 111, i.e. the toward the side opposite the male fastening plate 41, to form an upper plate 423, and the tip of the upper plate 423 is bent downwards to form an outer plate 422, whereby the female fastening plate 42 is provided.

At this time, the distance between the inner plate 421 and the outer plate 422 may be equal to or greater than the sectional thickness of the male fastening plate 41.

A male fastening plate 41 of an adjacent waterproofing system is fitted and coupled into the gap between the inner plate 421 and the outer plate 422 of the female fastening plate 42, formed as described above, whereby the waterproofing systems are detachably coupled to each other.

Meanwhile, a 3-1 process of bending one of the side walls 20 to form a cover 50' for fixing a corresponding side wall formed at an adjacent floor panel (S131) may be further included after the third process (S130).

At this time, the cover 50' may be formed by bending the upper part of one of the side walls horizontally toward the outside of the floor panel and bending the tip of the side wall downwards toward the floor panel, and may be formed such that the width of the horizontally bent portion thereof gradually increases from one side to the other side thereof, whereby a corresponding side wall of an adjacent floor panel is fitted and coupled into the cover.

The fourth process (S140) is a process of integrally forming the floor panel 10, the side walls 20, the male fastening plate 41, and the female fastening plate 42, formed in the above processes, by argon welding. The fourth process (S140) is performed in order to prevent soil/waste water from escaping through the gaps between the respective plates. In addition, the bent portion is maximally prevented from being distorted or damaged when the waterproofing system is dropped during construction.

The fifth process (S150) is a process of forming at least one drainage hole 31 in the floor panel 10. The drainage hole 31 may be formed by punching the floor panel 10 using a press punching machine. In another embodiment, a 5-1 process of forming a plurality of incision lines radially in the floor panel from the center to the outer circumference of the drainage hole 31 and bending the incised portions from the floor panel 10 upwards or downwards to form a plurality of incised pieces 311 (S151) may be further included.

The sixth process (S160) is a process of inserting one of a soil pipe 32, a drainage pipe 33, a washbowl drainage pipe 34, and a residual water pipe 35 through the drainage hole 31 and fixing the inserted pipe to the floor panel 10 by argon welding.

At this time, the soil pipe 32, the drainage pipe 33, and the washbowl drainage pipe 34 are inserted so as to protrude upwards and downwards from the floor panel 10, and the residual water pipe 35 is inserted so as to protrude only downwards from the floor panel 10. These pipes are fixed by argon welding.

Meanwhile, in the case in which the incised pieces 311 are formed in the fifth process (S150), the incised pieces 311 may be disposed so as to contact the outer circumferential surface of each inserted pipe, and the contact surfaces may be integrally fixed to each other by argon welding.

Unexplained reference numeral 70 indicates a joint at which each pipe is coupled to the floor panel by argon welding.

The bathroom floor waterproofing system manufactured using the above method is rust-resistant even when used for a long period of time, since the bathroom floor waterproofing system is made of stainless steel, whereby the durability of the bathroom floor waterproofing system is improved. In addition, a plurality of waterproofing systems is detachably coupled to each other. Consequently, the waterproofing systems are easily constructed even in the state in which the walls of a bathroom, which is under construction, are completed. Furthermore, the bathroom floor waterproofing system can be assembled immediately at a construction site. That is, only flat stainless steel sheets may be stored or transported before construction. When the waterproofing system is stored, therefore, it is possible to reduce the volume of the waterproofing system. In addition, it is easy to transport the waterproofing system.

Figure 7:
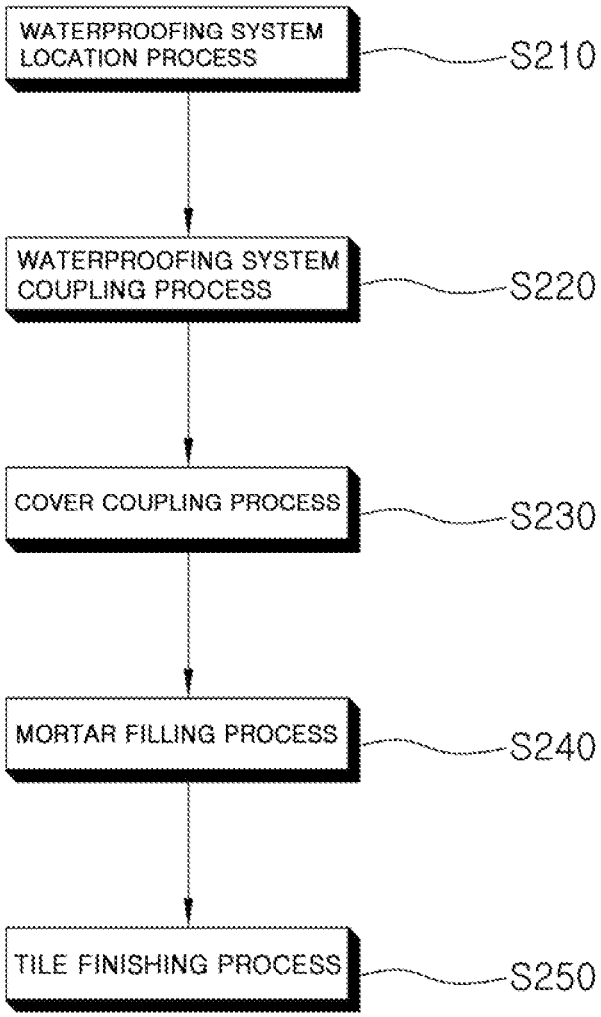
FIG. 7 is a flowchart showing processes of a method of constructing the bathroom floor waterproofing system according to the present invention.

FIG. 7 is a flowchart showing a method of constructing the bathroom floor waterproofing system according to the present invention, and FIG. 8 is a conceptual view showing the state in which the bathroom floor waterproofing system according to the present invention is constructed using the method of constructing the bathroom floor waterproofing system according to the present invention. The method of constructing the bathroom floor waterproofing system according to the present invention includes a waterproofing system location process (S210), a waterproofing system coupling process (S220), a cover coupling process (S230), a mortar filling process (S240), and a tile finishing process (S250).

The waterproofing system location process (S210) is a process of locating a waterproofing system 1 on a bathroom floor and fitting and coupling a soil pipe 32, a drainage pipe 33, a washbowl drainage pipe 34, and a residual water pipe 35 provided at the waterproofing system 1 into drainage holes 211 formed in the bathroom floor in advance.

The drainage holes 211 may be formed by casting concrete so as to be formed when the concrete is casted on the bathroom floor or by drilling the casted concrete.

The soil pipe 32, the drainage pipe 33, the washbowl drainage pipe 34, and the residual water pipe 35 are fitted and coupled into the drainage holes 211 formed in advance as described above such that the bottom of the waterproofing system 1 comes into tight contact with the top of the concrete floor.

In the case in which the waterproofing system location process (S210) is performed, it is possible to greatly reduce the construction time. That is, a plurality of drainage holes 211 is prepared at predetermined positions, and the pipes provided at the waterproofing system 1 are fitted into the drainage holes, whereby construction time is greatly reduced. In addition, a standardized waterproofing system 1 may be manufactured and constructed, whereby uniformity of quality is improved.

The waterproofing system coupling process (S220) is a process of locating a plurality of waterproofing systems 1 at a single construction site such that the waterproofing systems 1 are in contact and coupling the waterproofing systems 1 to each other through a fastening unit 40 formed at each waterproofing system 1. Consequently, the waterproofing system 1 according to the present invention can be constructed even after all of the walls of a bathroom, which is under construction, are formed.

A conventional waterproofing system has an area equivalent to the area of a bathroom floor in a single construction site. For this reason, it is possible to put the waterproofing system on the bathroom floor only when at least two walls of the bathroom are not completed. If the walls of the bathroom are completed, the waterproofing system is put on the bathroom floor through the door of the bathroom in the state in which the waterproofing system is inclined at an angle from the state in which the waterproofing system is erected or laid down, and is laid down in the same form as the bathroom floor so as to be located on the bathroom floor. When the inclined waterproofing system is returned to the original position thereof, however, the corners or side walls of the waterproofing system may come into contact with the walls of the bathroom, whereby the walls of the bathroom may be scratched or torn. In addition, the waterproofing system may be broken or deformed.

In contrast, the waterproofing system 1 according to the present invention is configured such that a plurality of waterproofing systems can be detachably coupled to each other. That is, the waterproofing system 1 according to the present invention is configured such that each of the waterproofing systems has an area smaller than the area of a bathroom floor, which is under construction. Even in the state in which all of the walls of the bathroom are completed, therefore, the waterproofing system can be put on the bathroom floor, whereby construction efficiency is improved.

The cover coupling process (S230) is a process of fitting covers 50 onto corresponding side walls of adjacent waterproofing systems 1 to fix the waterproofing systems 1. The waterproofing systems 1 are prevented from being dislocated in the state of being coupled to each other by a fastening unit 40.

Next, the mortar filling process (S240) is a process of applying mortar 212 onto the floor panel 10 of the waterproofing system 1. The material, mixing ratio, etc. of the mortar 212 used in this process are common, and therefore a detailed description thereof will be omitted.

Next, the tile finishing process (S250) is a process of attaching tiles 213 to the top of the mortar 212. At this time, the surface height of the tiles 213 is lower than the height of each side wall 20 of the waterproofing system 1 in order to prevent soil remaining on the surfaces of the tiles 213 from flowing over the side walls 20, thereby maximally preventing the occurrence of water leakage or the formation of cracks in the concrete floor.

In the case in which the construction method according to the present invention as described above is used, the respective pipes of the waterproofing system are inserted through the drainage holes formed in advance, and the waterproofing system is located on the concrete floor, whereby it is possible to reduce construction time. In addition, a plurality of waterproofing systems is detachably coupled to each other so as to be placed on a single bathroom floor. Even after all of the walls of the bathroom are completed, therefore, it is possible to easily place the waterproofing systems on the bathroom floor. Furthermore, dislocation of the waterproofing systems arranged on the bathroom floor is prevented, whereby the quality of the waterproofing systems is improved.

As is apparent from the above description, the present invention has been described with reference to specific matters, such as concrete elements, limited embodiments, and the drawings. However, these are provided only for overall comprehension of the present invention, and therefore the present invention is not limited to the above-described embodiments, and various modifications and alternations may be made by those skilled in the art to which the present invention pertains from the above description.

Therefore, the idea of the present invention should not be limited to the described embodiments, and not only the following claims but also all matters equivalent to the claims fall within the category of the present invention.

The invention claimed is:

1. A bathroom floor waterproofing system comprising:

a flat floor panel (10) made of stainless steel;

at least one drainage unit (30) provided at the floor panel (10), the drainage unit comprising a soil pipe (32) connected to a toilet bowl installed in a bathroom for discharging filth, a drainage pipe (33) for draining soil discharged from a bathroom floor, a washbowl drainage pipe (34) connected to a washbowl for draining soil discharged from the washbowl, a residual water pipe (35) for discharging moisture contained in mortar concrete during construction or moisture introduced into the bathroom during/after construction and moisture generated in the bathroom due to a temperature difference after construction, and at least one drainage hole (31) to which the soil pipe (32), the drainage pipe (33), the washbowl drainage pipe (34), and the residual water pipe (35) are coupled;

side walls (20) formed by bending a pair of opposite edges of the floor panel (10) upwards; and a fastening unit (40) comprising a male fastening plate (41) formed by bending one of the edges of the floor panel (10) upwards so as to be perpendicular to the floor panel (10) and a female fastening plate into which the male fastening plate (41) of an adjacent bathroom floor waterproofing system is detachably fitted and coupled.

2. The bathroom floor waterproofing system according to claim 1, wherein the female fastening plate (42) comprises an inner plate (421) formed by bending the other of the edges of the floor panel (10) upwards perpendicularly, an upper plate (423) formed by bending an upper part of the inner plate (421) outwards so as to be parallel to a middle of the floor panel (10), an outer plate (422) formed by bending a tip of the upper plate (423) downwards perpendicularly toward the floor panel (10), and a fastening groove (424) defined between the inner plate (421) and the outer plate (422).

3. The bathroom floor waterproofing system according to claim 1, further comprising:

a cover (50) fitted onto the side wall (2) of a plurality of bathroom floor waterproofing systems disposed so as to neighbor each other, wherein the cover comprises a pair of vertical plates (51) spaced apart from each other, a horizontal plate (52) for interconnecting upper ends of the vertical plates (51), and a fitting groove (53) defined between the vertical plates (51).

4. A method of manufacturing a bathroom floor waterproofing system, the method comprising:

a first process of preparing a flat stainless steel sheet (111), forming a bent portion (112) along a perimeter portion of the stainless steel sheet (111), and incising a part of the bent portion (112) from an edge of the stainless steel sheet (111) toward a middle thereof (S110);

a second process of bending remaining sides of the perimeter portion of the stainless steel sheet (111), excluding one side thereof, upwards perpendicularly along the bent portion (112) to form a floor panel (10), side walls (20), and a male fastening plate (41) (S120);

a third process of bending the perimeter portion of the stainless steel sheet (111) upwards perpendicularly along one side of the bent portion (112) located opposite the male fastening plate (41), bending an upper end of the perimeter portion horizontally so as to face an outward direction of the stainless steel sheet (111), and bending a tip of the perimeter portion downwards to form a female fastening plate (42) (S130);

a fourth process of integrally welding the side walls (20), the male fastening plate (41), and the female fastening plate (42) to the floor panel (10) by argon welding (S140);

a fifth process of forming at least one drainage hole (31) in the floor panel (10) (S150); and a sixth process of inserting one of a soil pipe (32), a drainage pipe (33), a washbowl drainage pipe (34), and a residual water pipe (35) through the drainage hole (31) and fixing the inserted pipe by argon welding (S160).

5. A method of constructing a bathroom floor waterproofing system, the method comprising:

a waterproofing system location process of fitting and coupling a soil pipe (32), a drainage pipe (33), a washbowl drainage pipe (34), and a residual water pipe (35) provided at a waterproofing system (1) into a plurality of drainage holes (211) formed in advance in a concrete floor of a bathroom such that a bottom of the waterproofing system (1) comes into tight contact with a top of the concrete floor (S210);

a waterproofing system coupling process of locating a plurality of waterproofing systems (1) so as to neighbor each other and coupling adjacent waterproofing systems to each other through a fastening unit (40) (S220);

a cover coupling process of coupling covers (50) to corresponding side walls of adjacent waterproofing systems (1) to fix the waterproofing systems (1) (S230);

a mortar filling process of applying mortar (212) onto the floor panel (10) of the waterproofing system (1) (S240); and a tile finishing process of attaching tiles (213) to a top of the mortar (212) (S250).

* * * * *